US009463615B2

(12) United States Patent
Turner

(10) Patent No.: US 9,463,615 B2
(45) Date of Patent: Oct. 11, 2016

(54) METHOD OF PRODUCING A HIGH QUALITY IMAGE ON A BLANKET

(71) Applicant: Kyle Thomas Turner, Boynton Beach, FL (US)

(72) Inventor: Kyle Thomas Turner, Boynton Beach, FL (US)

( * ) Notice: Subject to any disclaimer, the term of this patent is extended or adjusted under 35 U.S.C. 154(b) by 0 days.

(21) Appl. No.: 15/062,376

(22) Filed: Mar. 7, 2016

(65) Prior Publication Data

US 2016/0257110 A1 Sep. 8, 2016

Related U.S. Application Data

(60) Provisional application No. 62/129,574, filed on Mar. 6, 2015.

(51) Int. Cl.
*B41J 2/15* (2006.01)
*B41F 16/02* (2006.01)

(52) U.S. Cl.
CPC ..... *B41F 16/02* (2013.01)

(58) Field of Classification Search
CPC ..... B41J 11/007; B41J 11/42; B41J 3/4075; B41J 3/4078
See application file for complete search history.

(56) References Cited

U.S. PATENT DOCUMENTS 5,658,471 A * 8/1997 Murthy ..... B41J 2/1601 216/2
7,067,184 B1 6/2006 Carkeek
7,410,932 B2 8/2008 Figueroa
8,475,905 B2 7/2013 Abrams
8,696,105 B1 * 4/2014 Moorlag ..... G03G 15/161 347/103
8,870,972 B2 10/2014 Grier et al.
8,883,293 B2 11/2014 Weedlun et al.
8,995,022 B1 * 3/2015 Vronsky ..... H01L 21/02288 257/40
9,180,728 B2 11/2015 Abrams
2004/0158942 A1 8/2004 Ho
2007/0082189 A1 4/2007 Gillette
2007/0161511 A1 7/2007 Wyllie
2009/0119818 A1 5/2009 Ngo et al.
2009/0155536 A1 6/2009 Chang

* cited by examiner

*Primary Examiner* — Lamson Nguyen
(74) *Attorney, Agent, or Firm* — The Concept Law Group, P.A.; Scott D. Smiley; Erin A. Martin

(57) ABSTRACT

A method of producing a high quality image on a blanket, including providing an image, a first piece of material having a substantially zero-nap upper surface configured to receive the image thereon, and a lower coupling surface. The method may include providing a second piece of material different than the first piece of material, the second piece of material having an upper coupling surface including a non-zero nap and a lower surface of a soft material. The method may include coupling the lower coupling surface of the first piece of material to the upper coupling surface of the second piece of material to form a single unit, while leaving the soft material of the second piece of material substantially exposed to an outside ambient environment, and incorporating the image within the substantially zero-nap upper surface of the first piece of material using a printing process.

20 Claims, 7 Drawing Sheets

METHOD OF PRODUCING A HIGH QUALITY IMAGE ON A BLANKET

CROSS-REFERENCE TO RELATED APPLICATION

This application claims priority to U.S. Provisional Patent Application No. 61/129,574 filed Mar. 6, 2015, the entirety of which is incorporated by reference.

FIELD OF THE INVENTION

The present invention relates generally to printing an image on an item, and, more particularly, relates to a method of producing a high quality image on a blanket with a nap.

BACKGROUND OF THE INVENTION

Devices and methods of transferring or printing images on apparel, blankets, towels, and the like are well known. Such images often appear in the form of sports figures, sports teams, music bands, fictional characters, family portraits, and the like. At least one known device used to adhere an image onto a piece of fabric is through appliqué. Generally speaking, the term appliqué refers to a decoration coupled to a larger piece of material. An appliqué is normally created by cutting a first piece of material and coupling the first piece of material to the surface of another larger piece of material. Such coupling normally occurs through sewing, the application of heat and pressure, or through the use of an alternative adhesive. Unfortunately, creating an appliqué can be a tedious and time consuming task, not only because a user must first cut along the pattern of the decoration, but also because the user must sew or otherwise couple the decoration to the larger piece of fabric.

Another known method of printing an image onto a piece of material is screen printing. Such method involves using a mesh to transfer ink onto the material, except in areas made impermeable to the ink by a blocking stencil. A blade, squeegee, or the like is moved across the screen to fill the open mesh apertures with the ink, and a reverse stroke then causes the screen to touch the material briefly along a line of contact. Such process causes the ink to wet the material and be pulled out of the mesh apertures as the screen springs back once the blade or squeegee has passed. Unfortunately, a user must take into account the diameter of the threads used and the thread count of the mesh, as such factors determine the amount of ink that is deposited onto the material. As an added disadvantage, the material must be adequately spread out prior to the ink transfer in order to produce a clear image.

There are also a number of disadvantages that exist with regard to printing fabrics by ink jet processes, because the ink deposited onto fabric by the ink jet process is often characterized by a very low viscosity. As such, the ink is prone to spreading on the fabric, thereby creating a distorted image. Further, select fabrics, such as blankets made of a fleece material, include a texture that enhances or promotes ink spreading, thereby resulting in a finished product that is blurry or otherwise exhibits a poor image quality. Even if the image is placed on the material's nap in a clear manner, when the nap is moved, the image will appear distorted.

Digital textile printing is another known method of printing an image onto a piece of material. Unfortunately, the dyes often used with digital textile printing fail to completely fix within the fibers of the fabric. As a result, the fabric may need to be washed and dried in order to wash the unfixed dyes from the fabric. Unfortunately, the printed textile images are al so susceptible to degrading or fading when the fabric is washed.

Therefore, a need exists to overcome the problems with the prior art as discussed above.

SUMMARY OF THE INVENTION

The invention provides a method of producing a high quality image on a blanket that overcomes the hereinafore-mentioned disadvantages of the heretofore-known devices and methods of this general type and that includes printing am image to a first piece of material having a substantially zero-nap upper surface and coupling the first piece of material to a second piece of material having a soft bottom surface.

With the foregoing and other objects in view, there is provided, in accordance with the invention, a method of producing a high quality image on a blanket, the method including providing an image, a first piece of material having a substantially zero-nap upper surface configured to receive the image thereon and a lower coupling surface opposite the substantially zero-nap upper surface. The method includes providing a second piece of material different than the first piece of material, the second piece of material including an upper coupling surface having a non-zero nap configured to couple to the lower coupling surface of the first piece of material and a lower surface opposite the upper coupling surface, the lower surface of a soft material. The method may include coupling the lower coupling surface of the first piece of material to the upper coupling surface of the second piece of material to form a single unit, while leaving the soft material of the lower surface of the second piece of material substantially exposed to an outside ambient environment and incorporating the image within the substantially zero-nap upper surface of the first piece of material using a printing process.

In accordance with another feature, the present invention may include the printing process being a sublimation process, the sublimation printing process including providing an intermediary image transfer sheet for receiving the image thereon, printing the image onto the intermediary image transfer sheet, placing the image and the intermediary image transfer sheet in contact with the substantially zero-nap upper surface of the first piece of material, and applying heat and pressure to the image, the intermediary image transfer sheet, and the substantially zero-nap upper surface of the first piece of material for a predetermined time period to transfer the image from the intermediary image transfer sheet to the substantially zero-nap upper surface of the first piece of material.

In accordance with a further feature of the present invention, the lower coupling surface of the first piece of material is coupled to the upper coupling surface of the second piece of material to form the single unit after incorporating the image onto the substantially zero-nap upper surface of the first piece of material.

In accordance with a further feature of the present invention, the method includes cutting the first piece of material and the second piece of material to a uniform length and a uniform width with respect to each other.

In accordance with the present invention, the first piece of material is of a woven polyester fabric.

In accordance with another feature, an embodiment of the present invention also includes the second piece of material being of a polyethylene terephthalate.

In accordance with yet another feature, an embodiment of the present invention includes the image being a high quality image.

In accordance with a further feature of the present invention, the method may include coupling a border member to a perimeter of the single unit.

In accordance with yet another feature, the method includes coupling the lower coupling surface of the first piece of material to the upper coupling surface of the second piece of material using a bonding machine to form the single unit.

In accordance with yet another feature, an embodiment of the present invention includes a method of producing a high quality image on a blanket, the method including providing an image, an intermediary image transfer sheet, a first fabric material, the first fabric material having a level surface and a coupling surface opposite the level surface, and a base made of a second soft material, the base including an upper coupling surface configured to receive the coupling surface of the first fabric material thereon and a lower surface exposing the second soft material of the base. The method may include coupling the coupling surface of the first fabric material to the upper coupling surface of the base to form a single unit, the single unit including the lower surface of the base disposing the soft material, printing the image onto the intermediary image transfer sheet, placing the image and the intermediary image transfer sheet in contact with the level surface of the first fabric material, and applying heat and pressure for a predetermined time period to the image, the intermediary image transfer sheet, and the level surface of the first fabric material to transfer the image onto the level surface of the first fabric material.

In accordance with a further feature of the present invention, the method may include applying heat and pressure for the predetermined time period to the image, the intermediary image transfer sheet, and the level surface of the first fabric material to transfer the image onto the level surface of the first fabric material prior to coupling the coupling surface of the first fabric material to the upper coupling surface of the base to form the single unit.

In accordance with another feature of the present invention, the lower surface of the base may be a body contact surface.

In accordance with another feature of the present invention, the first fabric material is a polyester material and the second soft material is a polyethylene terephthalate.

In accordance with yet another feature of the present invention, the method may include coupling the coupling surface of the first fabric material to the upper coupling surface of the base to form the single unit using a bonding agent applied to at least one of the coupling surface of the first fabric material and the upper coupling surface of the base.

In accordance with another feature of the present invention, the method includes cutting the single unit to a predetermined length and a predetermined width and coupling a border member to a perimeter of the single unit.

In accordance with yet another feature, an embodiment of the present invention includes a method of producing a high quality image on a dual-material blanket, the method including printing an image, coupling the image to a top substantially zero-nap surface of a first piece of material, the first piece of material including a bottom surface opposite the top substantially zero-nap surface, and coupling the bottom surface of the first piece of material to a top surface of a second piece of material different than the first piece of material, the second piece of material having a soft body contact surface opposite the top substantially zero-nap surface.

In accordance with another feature of the present invention, the first piece of material is a polyester material and the second piece of material is a polyethylene terephthalate.

In accordance with yet another feature of the present invention, the method may include placing the first piece of material and the second piece of material through a bonding machine.

In accordance with a further feature of the present invention, the method may include coupling the image to the top substantially zero-nap surface of the first piece of material using a sublimation process.

In accordance with another feature of the present invention, the image is a high quality image.

Although the invention is illustrated and described herein as embodied in a method of producing a high quality image on a blanket, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the blanket.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
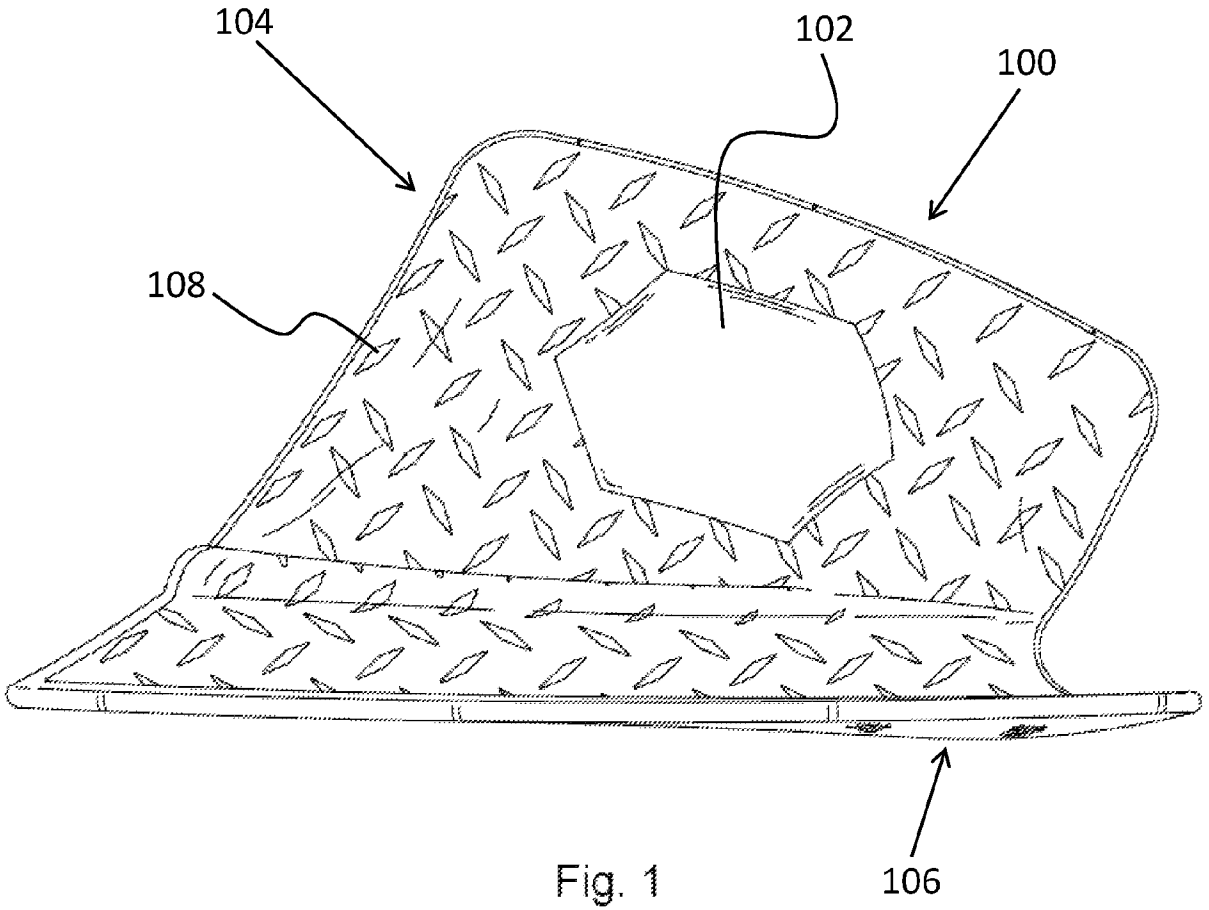
FIG. 1 is a perspective front view of a blanket having a high quality image coupled thereto in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient method of producing a high quality image on a blanket, e.g., a fleece blanket. Embodiments of the invention include coupling a first piece of material having a substantially zero-nap upper surface to a second piece of material including a soft lower surface that is intended to make contact with a user of the blanket. The method includes printing and transferring an image to the substantially zero-nap upper surface of the first piece of material using a printing process, such as sublimation printing. Advantageously, transferring the image to the substantially zero-nap upper surface of the first piece of material, as opposed to directly onto the second fleece material, provides a high quality image, as the ink is not susceptible to the spreading or smearing that would otherwise occur if the image were printed directly onto the second piece of material including the nap.

Referring now to FIG. 1, one embodiment of the present invention is shown in a perspective front view. FIG. 1 shows several advantageous features of the present invention, but, as will be described below, the invention can be provided in several shapes, sizes, combinations of features and components, and varying numbers and functions of the components. The first example of a blanket 100, also referred to as a dual-material blanket, as shown in FIG. 1, includes an image 102, a first piece of material 104, and a second piece of material 106 coupled to the first piece of material 104. In a preferred embodiment, the first piece of material 104 is of a different type of material than the second piece of material 106, as will be explained in further detail herein. Although the present method is described with reference to the blanket 100, the present method is not limited to use with a blanket; rather, it may be used with other items as well, including, but not limited to, apparel, towels, and the like.

The image 102 is defined herein in its broadest possible sense as a visual representation produced by a camera, artist, etc., and may include a digital image, non-digital image, high definition image, and the like. The image 102 may be, for example, a logo of a sports team, a photograph of a family, a photo of a pet, etc. In a preferred embodiment, the image 102 is produced as a high quality image. The term "high quality image" is defined herein as having sharp and clean lines that are not visibly distorted when viewed by a user.

Figure 2:
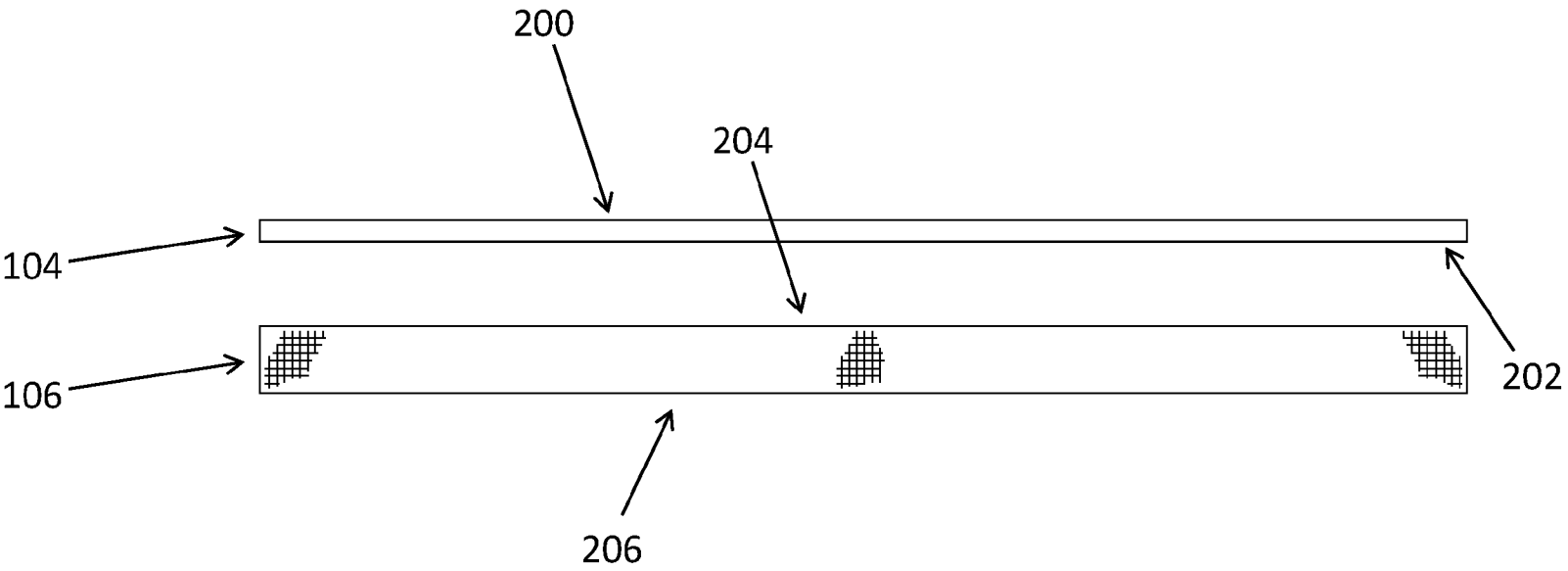
FIG. 2 is an elevational schematic block side view representing materials used to make the blanket of FIG. 1, including a first piece of material having a substantially zero-nap upper surface and a second piece of material having a lower surface of a soft material with a nap.
Figure 7:
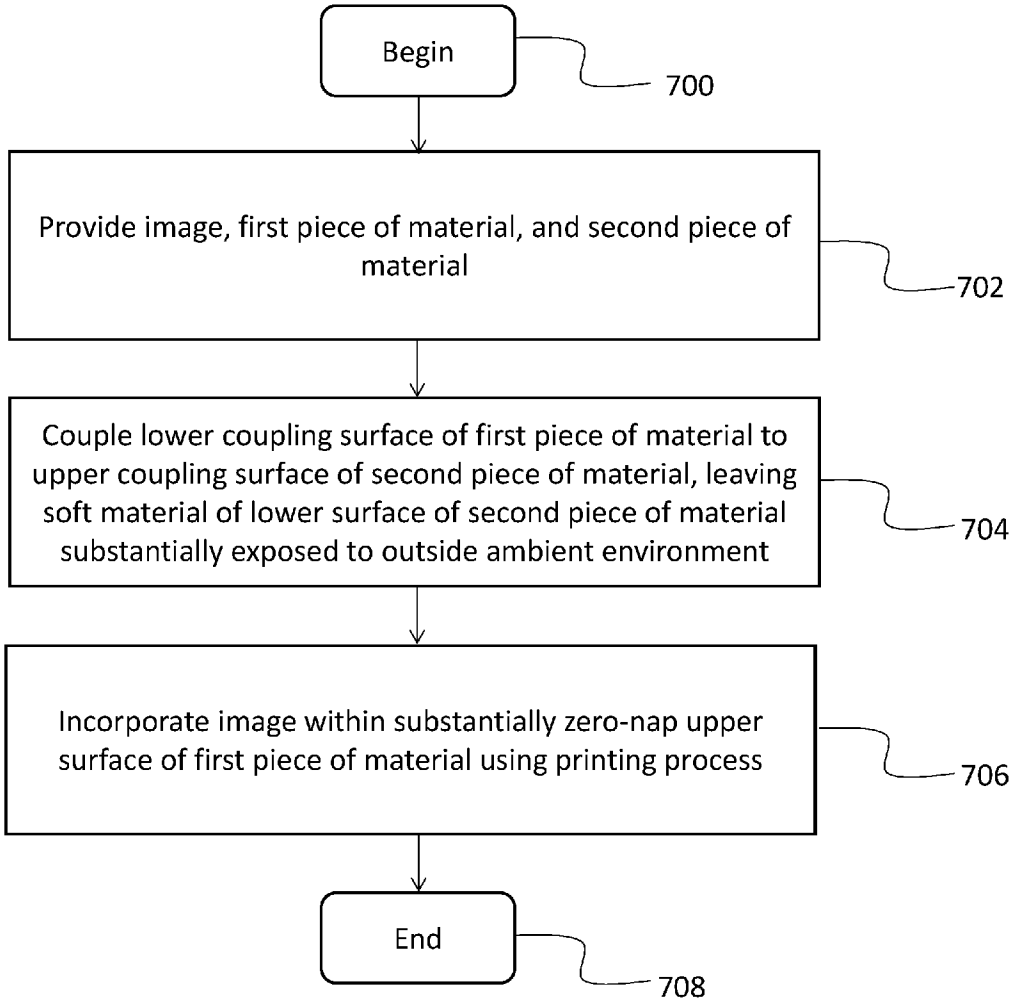
FIG. 7 is a process flow chart showing a method of producing a high quality image on a blanket with a nap.

With reference to FIGS. 1 and 2, in conjunction with the process flow diagram of FIG. 7, there is provided a method of producing a high quality image on a blanket, such as the image 102 on the blanket 100. The steps delineated in the exemplary process flow diagram of FIG. 7 are merely exemplary of the preferred order of producing a high quality image on a blanket, and said steps may be carried out in another order, with or without additional steps included therein.

In one embodiment, the method begins at step 700 and moves directly to step 702, where, in order to produce the blanket 100 having the image 102 (FIG. 1) visible thereon, the first piece of material 104 and the second piece of material 106 are provided by a user. The first and/or second pieces of material 104, 106 may be provided on a single sheet, a roll of material, or via another suitable manner.

In one embodiment, the first piece of material 104 is a durable polyester material having the ability to retain its shape. For example, the first piece of material 104 may be, but is not limited to, a polyester cloth, woven polyester fabric, or any non-woven or other fabric suitable for printing thereon. In one embodiment, the first piece of material 104 may be a flocked material having a plurality of small fiber particles flocked onto a substantially zero-nap upper surface 200 of the first piece of material 104 to create a patterned design 108. In another embodiment, the patterned design 108 may be printed on the material to form a portion of the image 102. In other embodiments, the patterned design 108 may be printed on the material in addition to the image 102. The term "substantially zero-nap" is defined herein as having a level and even surface with minimal slopes or bumps. In one embodiment, the term "substantially zero-nap" includes a moderate or minimal amount of nap. In other embodiments, the term "substantially zero-nap" includes no nap. The term "level" is defined herein as a relatively smooth surface, i.e., having substantially zero-nap. The term "nap" is defined herein as a raised or fuzzy surface. The term "nap" includes, but is not limited to, fabric having raised fibers that have gone through a finishing process which raises the fiber ends to a surface, such that the ends may be clipped, brushed, or left disposed in an upright direction, thereby creating a soft surface texture.

In one embodiment, the second piece of material 106 is a polyethylene terephthalate (PET) material, such as a fuzzy or flurry fleece material, that includes the nap. In another embodiment, the second piece of material 106 may be made a wool, a synthetic fiber, a natural fiber, a combination of the aforementioned materials having varying composition percentages, or the like. In a preferred embodiment, the second piece of material 106 is a soft material that is smooth and pleasant to touch. The second piece of material 106 may be commonly referred to as a fleece material.

The first piece of material 104 is depicted having the substantially zero-nap upper surface 200 configured to receive the image 102 and/or the patterned design 108 (FIG. 1) thereon. In another embodiment, the first piece of material 104 may include a non-zero nap surface, although the substantially zero-nap upper surface 200 is preferred, so as to increase the aesthetically pleasing appearance of the image 102 and/or the patterned design 108 when placed on the substantially zero-nap upper surface 200.

With reference to FIG. 2, an elevational schematic block side view representing the materials used to make the blanket 100 is shown. The schematic block side view is shown for illustrative purposes only and does not depict the actual dimensions of the materials, e.g., the first and second pieces of material 104, 106. As shown in FIG. 2, in one embodiment, opposite the substantially zero-nap upper surface 200, is a lower coupling surface 202 that may or may not be substantially zero-nap, i.e., sub-zero nap. As can be readily understood by a person of ordinary skill in the art, the lower coupling surface 202 may be the substantially zero-nap upper surface 200 and vice versa, depending on the respective orientation of the blanket 100 with respect to a ground surface.

With reference to FIG. 2, the second piece of material 106 is depicted having an upper coupling surface 204 configured to couple to the lower coupling surface 202 of the first piece of material 104. The second piece of material 106 may be referred to as a base, as the second piece of material 106 is intended to support the first piece of material 104 when coupled thereto. The second piece of material 106 also includes a lower surface 206 opposite the upper coupling surface 204. In a preferred embodiment, the lower surface 206 includes the soft material, e.g., nap, or another soft polyester material substantially exposed to an outside ambient environment. The lower surface 206 is intended to make contact with a user when using the blanket 100, i.e., the lower surface 206 forms a body contact surface. The term "substantially exposed" is defined herein as at least 75% of the lower surface 206 being accessible to a user, with the remaining portion covered by a border around a perimeter, as will be explained in further detail below. Similar to that described with respect to the first piece of material 104, the lower surface 206 may be the upper coupling surface 204 and vice versa, depending on the respective orientation of the blanket 100 with respect to a ground surface.

Figure 3:
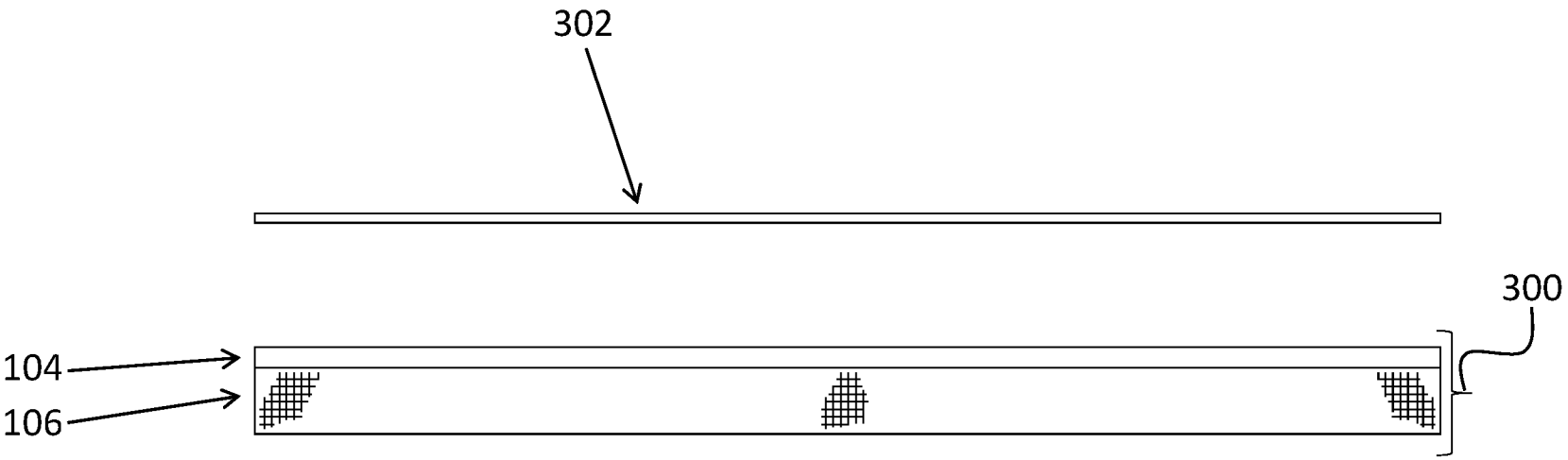
FIG. 3 is an elevational schematic block side view representing materials used to make the blanket of FIG. 1, including an intermediary image transfer sheet and the first piece of material coupled to the second piece of material of FIG. 2.

With reference now to FIG. 3, in conjunction with the process flow diagram of FIG. 7, in one embodiment, step 704 includes coupling the first piece of material 104 to the second piece of material 106 to form a single unit 300. Similar to that described with respect to FIG. 2, the schematic block side view of FIG. 3 is shown for illustrative purposes only, and does not depict the actual dimensions of the materials provided in the present method. In a preferred embodiment, the first and second pieces of material 104, 106 are coupled to each other to form the single unit 300 using a bonding machine. The bonding machine may be any type of bonding machine suitable for use with the materials provided herein, including, but not limited to bonding machines which utilize rollers and an adhesive to bond materials together. With brief reference to FIG. 4, an exemplary heat roller 400 is depicted. In one embodiment, an adhesive may be applied to at least one of the lower coupling surface 202 of the first piece of material 104 and the upper coupling surface 204 of the second piece of material 106 to bind the pieces of material 104, 106 together. The adhesive may be, without limitation, a glue, for example a polyurethane glue having a moisture curing reactive polyurethane hot melt adhesive, or another type of glue. In other embodiments, the first and second pieces of material 104, 106 are coupled to each other using a sewing method or another coupling mechanism.

In step 706, in one non-limiting embodiment, the present method includes transferring, i.e., incorporating, the image 102 within the first layer of material 104 using a sublimation printing process. More specifically, in one embodiment, an intermediary image transfer sheet 302 is provided for receiving the image 102 (FIG. 1) thereon. The sublimation printing process, because such process is known to those of ordinary skill in the art, will be described generally herein. In one embodiment, the sublimation printing process includes printing the image 102 (FIG. 1) onto the intermediary image transfer sheet 302 after the image 102 has been selected and adjusted to a desired size and color by the user. Generally speaking, the intermediary image transfer sheet 302 may be a transfer sheet paper, as known to those of ordinary skill in the art. In one non-limiting embodiment, the intermediary image transfer sheet 302 is a Havier digital dye sublimation 70 gsm coated paper. In one embodiment, the image 102 is printed onto the intermediary image transfer sheet 302 using a sublimation dye that is transferred to the intermediary image transfer sheet 302 using a liquid gel ink through a piezoelectric print head. In other embodiments, alternative methods of sublimation printing may be used.

Figure 4:
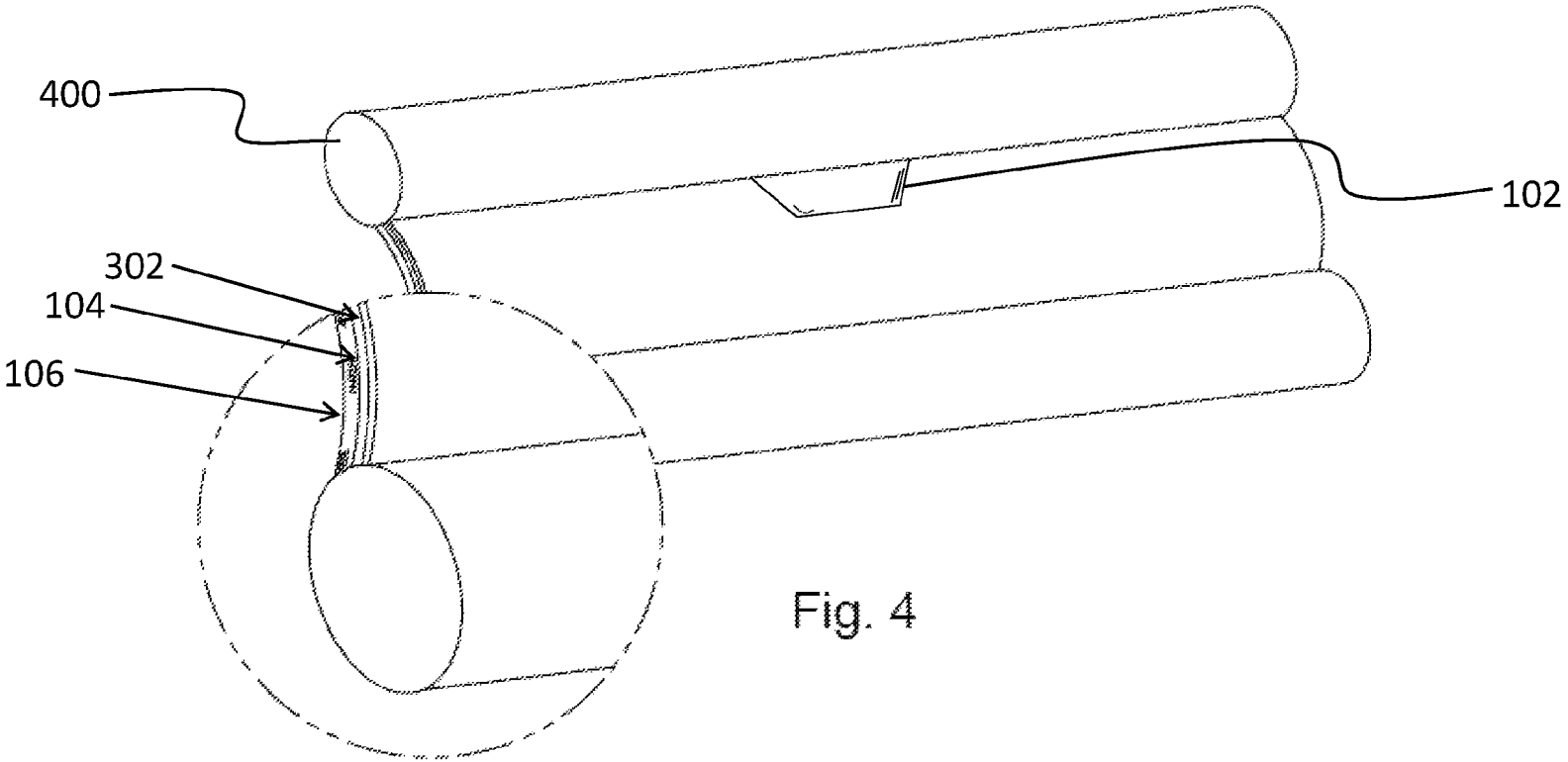
FIG. 4 is a perspective front view of the intermediary image transfer sheet, the first piece of material, and the second piece of material of FIG. 2 exposed to at least one heat roller.

With reference to FIG. 4, in one embodiment, the present method includes placing the image 102 and the intermediary image transfer sheet 302 in contact with the substantially zero-nap upper surface 200 (FIG. 2) of the first piece of material 104 to couple the image 102 to the substantially zero-nap upper surface 200. In one embodiment, the image 102 is coupled to the substantially zero-nap upper surface 200 of the first piece of material 104 after the first piece of material 104 has been coupled to the second piece of material 106 to form the single unit 300 (FIG. 3). In another embodiment, the image 102 is transferred to the substantially zero-nap upper surface 200 of the first piece of material 104 before the first piece of material 104 has been coupled to the second piece of material 106 to form the single unit 300 (FIG. 3).

In one non-limiting embodiment, the image 102 is incorporated, i.e., transferred, to the substantially zero-nap upper surface 200 of the first piece of material 104 by applying heat and pressure for a predetermined time period to the image 102, the intermediary image transfer sheet 302, and the first piece of material 104. Such transfer step results in the transfer of the sublimation dye at the molecular level into the substantially zero-nap upper surface 200 of the first piece of material. Said another way, the image 102 is permanently incorporated within the first piece of material 104. Advantageously, permanently incorporating the image 102 within the first piece of material 104 prevents the image 102 from fading, washing out in the washing machine, or peeling off of the first piece of material 104. As an added advantage, printing and transferring the image 102 onto the first piece of material 104 presents a significant advantage over printing the image 102 directly onto the second piece of material 106, e.g., the fleece material, as the image is produced as the high quality image 102. Said another way, if the ink making up the image 102 were printed directly onto the second piece of material 106, such ink would smear or spread, thereby creating a distorted and unaesthetically appealing image 102.

In one embodiment, the heat and pressure applied to the first piece of material 104 are supplied by at least one heat roller 400. The heat roller 400 may be coupled to a heat press, e.g., a Practix OK-450R Rotary Transfer Machine. In one embodiment, the temperature of the heat transmitted is between approximately 380 to 420 degrees Fahrenheit, as such temperature is recommend for optimal color during the sublimation process. In other embodiments, the temperature may be outside of this range. The predetermined time period and amount of pressure supplied may vary according to the sublimation dye, the materials used, etc. Although the present invention is described herein as including a sublimation printing process, such process is not intended to be limiting and other types of printing processes are within the scope of the present invention. For example, in other embodiments, an ink jet printer may be used to print the image onto the first piece of material 104.

Figure 5:
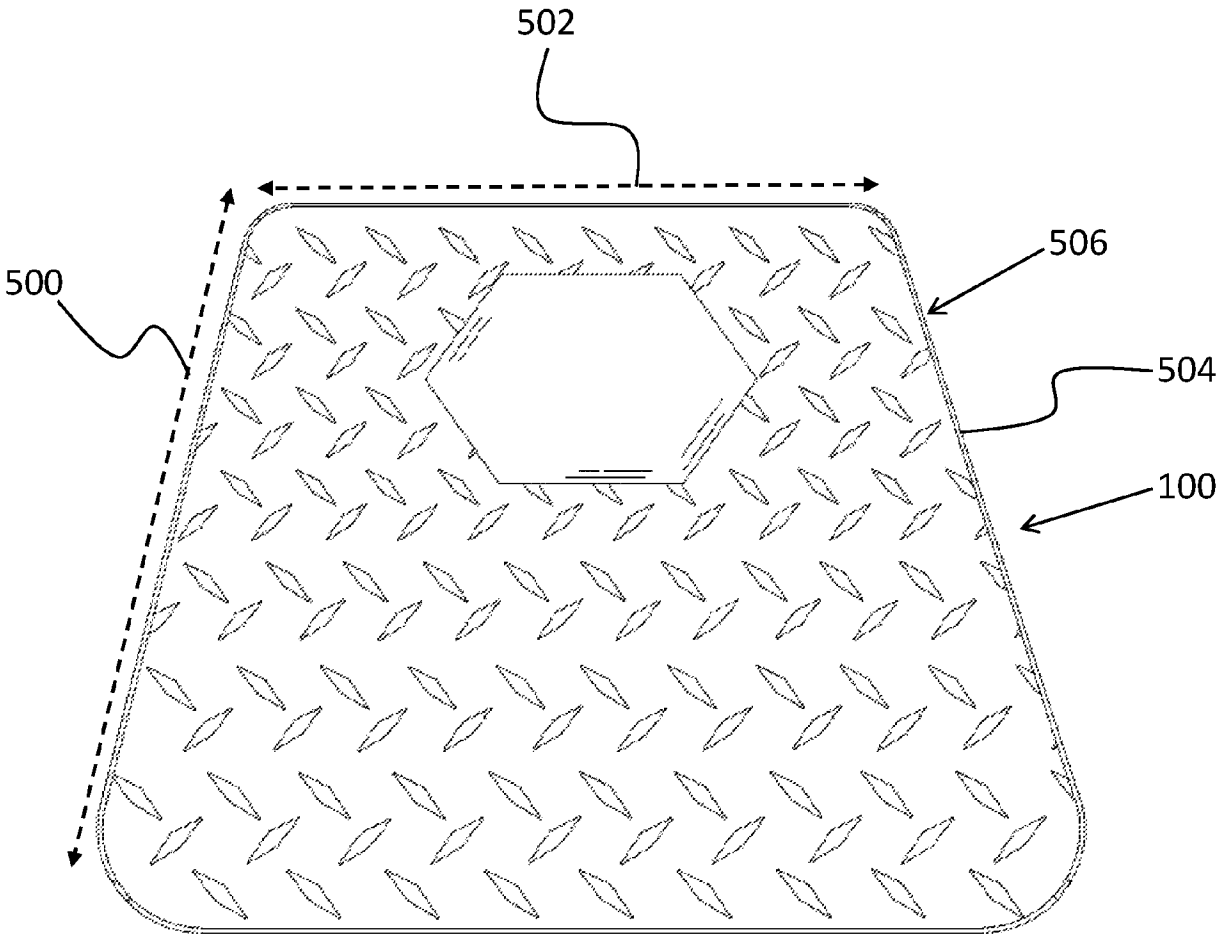
FIG. 5 is a perspective, partially exploded view of the blanket of FIG. 1 having the high quality image coupled thereto.

With reference now to FIG. 5, in order to complete the blanket 100, the first piece of material 104 and the second piece of material 106 are cut to a uniform length 500. In a preferred embodiment, the first and second pieces of material 104, 106 may also be cut to a uniform width 502 to create an aesthetically appealing blanket having uniform dimensions. The pieces of material 104, 106 may be cut manually or through the use of a machine.

In one embodiment the length 500 may be between approximately 4-5 feet and the width 502 may be between approximately 5-6 feet. In other embodiments, the length 500 and the width 502 may vary outside of these ranges. The length 500 and the width 502 may vary according to user preference or the desired end user of the blanket 100, e.g., a child, adult, pet, or the like. FIG. 5 depicts the blanket 100 having rectangular shape, however such embodiment is provided for illustrative purposes only and the blanket 100 may be provided as circular, square, oval, round, or another non-limiting shape.

In one embodiment, in order to complete the blanket 100, a border member 504, i.e., fastener, is applied to a perimeter 506 of the blanket 100. In one embodiment, the border member 504 is a binding tape having adhesive properties. The border member 504 couples the perimeter 506 of the first and second pieces of material together 104, 106 (FIG. 4) to conceal any frayed edges and provide the blanket 100 with uniform and neat edges that are aesthetically appealing. In one embodiment, the border member 504 includes a width of at least 0.5-1.0 inch. In other embodiments, the width may be outside of this range. In another embodiment, the border member 504 may be another piece of material, a snap configuration, a hook and loop attachment, or the like. With reference to FIG. 7, The process ends at step 708.

Figure 6:
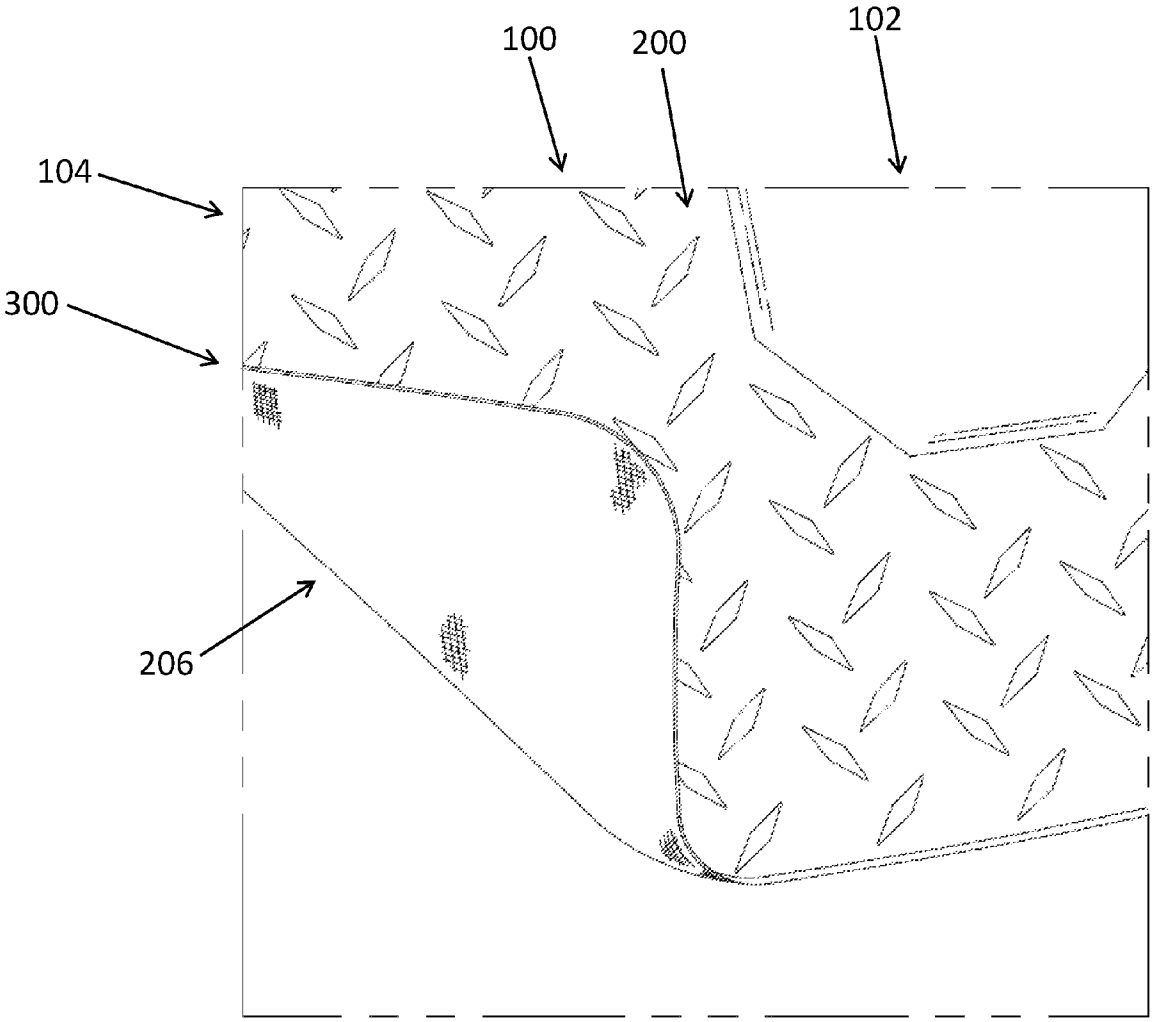
FIG. 6 is a partial perspective view of the blanket of FIG. 1 in accordance with an exemplary embodiment of the present invention.

With reference now to FIG. 6, the blanket 100 is depicted as the single unit 300 including the image 102 clearly displayed on the substantially zero-nap upper surface 200 of the first piece of material 104. The soft material can be seen disposed on the lower surface 206 of the second piece of material 106. Advantageously, printing the image 102 onto the first piece of material 104, rather than directly to the second piece of material 106, provides the user with the blanket 100 that not only provides comfort to the user, but also includes a high resolution image 102 that is aesthetically appealing.

A method of producing a high quality image on a blanket has been disclosed that includes an upper surface displaying a high resolution image and a lower surface that includes a soft material to provide comfort to the user.

What is claimed is:

1. A method of producing a high quality image on a blanket, the method comprising:

providing:

an image;

a first piece of material including:

a substantially zero-nap upper surface configured to receive the image thereon; and a lower coupling surface opposite the substantially zero-nap upper surface; and a second piece of material different than the first piece of material, the second piece of material including:

an upper coupling surface having a non-zero nap configured to couple to the lower coupling surface of the first piece of material; and a lower surface opposite the upper coupling surface, the lower surface of a soft material;

coupling the lower coupling surface of the first piece of material to the upper coupling surface of the second piece of material to form a single unit, while leaving the soft material of the lower surface of the second piece of material substantially exposed to an outside ambient environment; and incorporating the image within the substantially zero-nap upper surface of the first piece of material using a printing process.

2. The method according to claim 1, wherein:

the printing process is a sublimation process, the sublimation printing process including:

providing an intermediary image transfer sheet for receiving the image thereon;

printing the image onto the intermediary image transfer sheet;

placing the image and the intermediary image transfer sheet in contact with the substantially zero-nap upper surface of the first piece of material; and applying heat and pressure to the image, the intermediary image transfer sheet, and the substantially zero-nap upper surface of the first piece of material for a predetermined time period to transfer the image from the intermediary image transfer sheet to the substantially zero-nap upper surface of the first piece of material.

3. The method according to claim 1, wherein:

the lower coupling surface of the first piece of material is coupled to the upper coupling surface of the second piece of material to form the single unit after incorporating the image onto the substantially zero-nap upper surface of the first piece of material.

4. The method according to claim 1, further comprising:

cutting the first piece of material and the second piece of material to a uniform length and a uniform width with respect to each other.

5. The method according to claim 1, wherein:

the first piece of material is of a woven polyester fabric.

6. The method according to claim 1, wherein:

the second piece of material is a polyethylene terephthalate.

7. The method according to claim 1, wherein:

the image is a high quality image.

8. The method according to claim 1, further comprising:
coupling a border member to a perimeter of the single unit.

9. The method according to claim 1, further comprising:
coupling the lower coupling surface of the first piece of material to the upper coupling surface of the second piece of material using a bonding machine to form the single unit.

10. A method of producing a high quality image on a blanket, the method comprising:
providing:
an image;
an intermediary image transfer sheet;
a first fabric material, the first fabric material including:
a level surface; and
a coupling surface opposite the level surface; and
a base made of a second soft material, the base including:
an upper coupling surface configured to receive the coupling surface of the first fabric material thereon; and
a lower surface exposing the second soft material of the base;
coupling the coupling surface of the first fabric material to the upper coupling surface of the base to form a single unit, the single unit including the lower surface of the base disposing the soft material;
printing the image onto the intermediary image transfer sheet;
placing the image and the intermediary image transfer sheet in contact with the level surface of the first fabric material; and
applying heat and pressure for a predetermined time period to the image, the intermediary image transfer sheet, and the level surface of the first fabric material to transfer the image onto the level surface of the first fabric material.

11. The method according to claim 10, further comprising:
applying heat and pressure for the predetermined time period to the image, the intermediary image transfer sheet, and the level surface of the first fabric material to transfer the image onto the level surface of the first fabric material prior to coupling the coupling surface of the first fabric material to the upper coupling surface of the base to form the single unit.

12. The method according to claim 10, wherein:
the lower surface of the base is a body contact surface.

13. The method according to claim 10, wherein:
the first fabric material is a polyester material; and
the second soft material is a polyethylene terephthalate.

14. The method according to claim 10, further comprising:
coupling the coupling surface of the first fabric material to the upper coupling surface of the base to form the single unit using a bonding agent applied to at least one of the coupling surface of the first fabric material and the upper coupling surface of the base.

15. The method according to claim 10, further comprising:
cutting the single unit to a predetermined length and a predetermined width; and
coupling a border member to a perimeter of the single unit.

16. A method of producing a high quality image on a dual-material blanket, the method comprising:
printing an image;
coupling the image to a top substantially zero-nap surface of a first piece of material, the first piece of material including a bottom surface opposite the top substantially zero-nap surface; and
coupling the bottom surface of the first piece of material to a top surface of a second piece of material different than the first piece of material, the second piece of material having a soft body contact surface opposite the top substantially zero-nap surface.

17. The method according to claim 16, wherein:
the first piece of material is a polyester material; and
the second piece of material is a polyethylene terephthalate.

18. The method according to claim 16, further comprising:
placing the first piece of material and the second piece of material through a bonding machine.

19. The method according to claim 16, further comprising:
coupling the image to the top substantially zero-nap surface of the first piece of material using a sublimation process.

20. The method according to claim 16, wherein:
the image is a high quality image.

* * * * *